US008174406B2

(12) United States Patent
Kraft, IV et al.

(10) Patent No.: US 8,174,406 B2
(45) Date of Patent: May 8, 2012

(54) DETECTING AND SHARING ROAD TRAFFIC CONDITION INFORMATION

(75) Inventors: George Kraft, IV, Austin, TX (US); Lawrence Frank Weiss, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 423 days.

(21) Appl. No.: 12/166,775

(22) Filed: Jul. 2, 2008

(65) Prior Publication Data

US 2010/0001880 A1 Jan. 7, 2010

(51) Int. Cl.
*G08G 1/09* (2006.01)

(52) U.S. Cl. ..... 340/905; 382/104; 701/117

(58) Field of Classification Search ..... 340/901, 340/905, 906, 995.12, 995.13; 701/117, 701/118, 119; 382/104, 105, 106
See application file for complete search history.

(56) References Cited

U.S. PATENT DOCUMENTS 5,485,819 A * 1/1996 Joko et al. ..... 123/321
5,486,819 A * 1/1996 Horie ..... 340/905
5,999,635 A * 12/1999 Higashikubo et al. ..... 382/104
6,337,191 B1 * 1/2002 Swartz et al. ..... 435/68.1
6,366,219 B1 * 4/2002 Hoummady ..... 340/907
6,377,191 B1 * 4/2002 Takubo ..... 340/937
6,420,977 B1 7/2002 Corbitt et al.
6,681,195 B1 * 1/2004 Poland et al. ..... 702/142
7,493,208 B1 * 2/2009 Craine ..... 701/117
2002/0008637 A1 * 1/2002 Lemelson et al. ..... 340/907

* cited by examiner

*Primary Examiner* — George Bugg
*Assistant Examiner* — Edny Labbees
(74) *Attorney, Agent, or Firm* — Garg Law Firm, PLLC; Rakesh Garg; David Mims

(57) ABSTRACT

A method, system, and computer usable program product for detecting and sharing road traffic condition information are provided in the illustrative embodiments. A system receives a set of image inputs from a set of cameras that are stationary relative to a road and monitoring road traffic. The system combines the image inputs forming a view. The system determines whether an alarm condition exists in the view. If an alarm condition exists, the system maps the alarm condition on the view using a characteristic of the alarm condition, thus forming a part of a condition information. The system transmits the part of the condition information, such that the part of the condition information can be received by a motorist. The system may also receive a set of sensor inputs from a set of sensors and may combine the set of sensor inputs with the set of image inputs to form the view.

20 Claims, 4 Drawing Sheets

DETECTING AND SHARING ROAD TRAFFIC CONDITION INFORMATION

BACKGROUND OF THE INVENTION

1. Field of the Invention

The present invention relates generally to an improved vehicular traffic management, and in particular, to a computer implemented method for managing road traffic information system. Still more particularly, the present invention relates to a computer implemented method, system, and computer usable program code for detecting and sharing road traffic condition information.

2. Description of the Related Art

A motorist's awareness of the surroundings is important for safe driving conditions. A motorist who may not be aware of a pedestrian may cause an accident with the pedestrian. A motorist who may not be aware of the presence of another vehicle in a direction of travel may cause a collision between the motorist's vehicle and the other vehicle.

Motorists use visual as well as audio clues about the surroundings in considering their courses of action. For example, a motorist may slow down or stop if the motorist becomes aware of a pedestrian in a cross-walk. Similarly, a motorist may navigate around an obstacle, such as a parked vehicle, if the motorist can see the vehicle. In some vehicles, vehicle-mounted sensors provide the motorist audible signals that warn the motorist about objects behind the vehicle and therefore out of the line of sight of the motorist.

Any aid to assist a motorist in evaluating the motorist's surroundings may reduce the possibility of collisions or other hazardous circumstances. However, presently available technology may not be sufficient for providing enough information to a motorist about certain conditions present in the surroundings under certain circumstances.

SUMMARY OF THE INVENTION

The illustrative embodiments provide a method, system, and computer usable program product for detecting and sharing road traffic condition information. A system receives a set of image inputs from a set of cameras monitoring road traffic. The set of cameras is stationary relative to a road. The system combines the image inputs forming a view. The system determines whether an alarm condition exists in the view. If an alarm condition exists, the system maps the alarm condition on the view using a characteristic of the alarm condition, thus forming a part of a condition information. The system transmits the part of the condition information, such that the part of the condition information can be received by a motorist.

The system may also receive a set of sensor inputs from a set of sensors. The system may combine the set of sensor inputs with the set of image inputs to form the view. The system may use a sensor input, an image input, or a combination of a sensor input and an image input to determine if the alarm condition exists.

The system may create a version of the part of the condition information from a particular vantage point in the road traffic. The system may transmit the version of the part of the condition information. The system may transmit the part of the condition information using unicasting, multicasting, broadcasting, or a combination thereof. The alarm condition may be an object that may be obscured from the view of the motorist.

BRIEF DESCRIPTION OF THE DRAWINGS

The novel features believed characteristic of the invention are set forth in the appended claims. The invention itself; however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
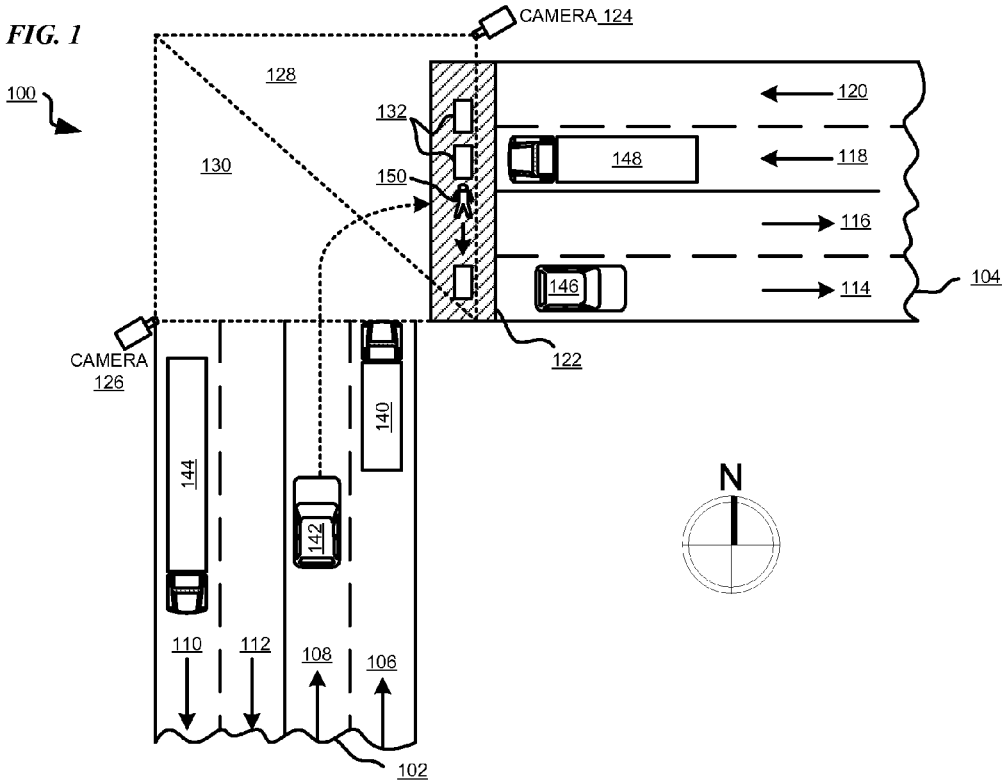
FIG. 1 depicts an example of surroundings about which condition information may be provided in accordance with an illustrative embodiment.

Illustrative embodiments recognize that motorists driving on roads do not always have a clear view of their surroundings. For example, at a road intersection, a vehicle present at the intersection may obstruct the view of a particular motorist. Foliage, objects, and structures in the proximity of the intersection may also interfere with a motorist's view of the intersection from certain vantage points.

To address these and other problems related to road traffic conditions, the illustrative embodiments provide a method, system, and computer usable program product for detecting and sharing road traffic condition information. Road traffic condition information is information about a motorist's surroundings. Road traffic condition information includes information about events, objects, and obstacles present in the motorist's surroundings that the motorist may not be able to perceive by a visual scan of the surroundings. An object may be a person in some instances.

For the purposes of this disclosure, the road traffic condition information detected and shared in the manner of the illustrative embodiments is called condition information. Condition information is information in addition to what a motorist is able to perceive about the surroundings without the aid of the illustrative embodiments.

For example, a motorist may see a car headed in the same direction as the direction of travel of the motorist's vehicle. Seeing the car is visually perceiving information about the car in the surrounding. The motorist, however, may not be able to perceive information about a pedestrian on the side of the car that is opposite from the side of the car that the motorist is able to perceive. In other words, the motorist may not see a pedestrian who may be obscured by the car. Information about the presence, location, and direction of travel of the pedestrian may be an example of the condition information according to the illustrative embodiments.

Generally, condition information according to the illustrative embodiments may include but is not limited to information about a type of an object, location of the object, and speed and direction of the object if the object is moving. The type of the object can be a category of the object, such as a human pedestrian, a bicyclist, a lane blockage barrier, or a stopped vehicle.

Condition information may further include a characteristic of the object, such as a color or shape of the object. These examples of the type of information that may be included in the condition information are not limiting on the illustrative embodiments. Many other variations of similar information, and other similarly usable information is contemplated within the scope of the illustrative embodiments.

Illustrative embodiments further recognize that many vehicles are equipped with some type of user interface that may be utilized in accordance with the illustrative embodiments to deliver the condition information to the motorist. For example, a vehicle may have an audio system using which the illustrative embodiments may provide the condition information in an audible manner. As another example, a vehicle may have a display. The illustrative embodiments may provide condition information using the display, with or without the audio system. Most vehicles include a device that beeps or chimes for notifying the motorist about various events occurring in the vehicle. The illustrative embodiments may also be used in conjunction with such a device to deliver condition information to a motorist.

Illustrative embodiments may provide the condition information about the motorist's surroundings by using the devices and systems present in a vehicle in conjunction with devices and systems present in the surroundings. For example, the illustrative embodiments may use a vehicle's data processing system in conjunction with a data processing system associated with a device present in the surroundings to provide the condition information to the motorist.

Illustrative embodiments may also be implemented as a combination of hardware and software. A unit resulting from such a combination may be portable or installable in a vehicle. An implementation may implement the illustrative embodiments in conjunction with a hardware component, such as in a firmware, as embedded software in a hardware device, or in any other suitable hardware or software form.

Furthermore, a particular implementation may use the illustrative embodiments in conjunction with any application or any data processing system that can process audio, video, or graphical information. Additionally, an implementation may use the illustrative embodiments in conjunction with a variety of communication protocols, such as WiFi, WiMax, or Bluetooth for wireless data communications.

An implementation may use any suitable transmission method or frequency band for transmitting the condition information. For example, an implementation of an illustrative embodiment may transmit the condition information using ultra high frequency (UHF), very high frequency (VHF), frequency modulation (FM), amplitude modulation (AM), or shortwave radio bands.

Any advantages listed herein are only examples and are not limiting on the illustrative embodiments. A particular embodiment may have some, all, or none of the advantages listed above. Furthermore, specific embodiments may realize additional or different advantages. Such additional or different advantages are contemplated within the scope of the illustrative embodiments.

With reference to FIG. 1, this figure depicts an example of surroundings about which condition information may be provided in accordance with an illustrative embodiment. Intersection 100 may be any road-surroundings that a motorist may perceive during everyday driving. In the example depicted in this figure, intersection 100 is formed of roads 102 and 104 heading North-South and East-West respectively only for the clarity of the description.

As an example, road 102 is depicted as divided into lanes 106 and 108 heading North, and lanes 110 and 112 heading South. Road 104 is similarly divided into lanes 114 and 116 heading East, and lanes 118 and 120 heading West as an example. Crossing 122 allows pedestrians and others to travel North or South across road 104. Other roads, lanes, pedestrian crossings, and road markings are omitted for clarity.

Cameras 124 and 126 may be still-picture or video cameras that may monitor the traffic flowing across intersection 100. For example, each of cameras 124 and 126 may be a camera that is located at a fixed position with respect to intersection 100 and monitors traffic-light violations across intersection 100. Note that each of cameras 124 and 126 may be capable of pan, zoom, and tilt movements while remaining relatively stationary with respect to intersection 100 and the roads therein.

Camera 124 has field of view 128, and camera 126 has field of view 130. Fields of view 128 and 130 together provide a complete view of intersection 100. In one embodiment, a single camera may be present at a given intersection. In another embodiment, multiple cameras of same or different kinds may be present at a given intersection.

In addition, sensors 132 may be any kind of transducers suitable for monitoring movement across crossing 122. Of course, sensors 132 may monitor other conditions and events in relation to intersection 100, such as smoke, fire, or presence of emergency vehicles. In one embodiment, sensors 132 may be used in conjunction with cameras 124 and 126 to monitor traffic across intersection 100.

Further, as an example to describe the illustrative embodiment, FIG. 1 depicts vehicle 140 that may be parked in lane 106. Vehicle 142 may be moving northbound in lane 108. Vehicle 144 may be parked in lane 110, vehicle 146 may be stopped in lane 114, and vehicle 148 may be waiting in lane 118.

In this example configuration of intersection 100, pedestrian 150 may be southbound, crossing road 104. Presently, without using the illustrative embodiments, the motorist of vehicle 142 may not perceive pedestrian 150 from certain vantage points on lane 108. For example, vehicle 140 may obstruct vehicle 142's motorist's view of pedestrian 150. Under such circumstances, and absent condition information according to the illustrative embodiments, vehicle 142 may collide with pedestrian 150 in attempting to make a right turn from lane 108 onto lane 116.

In the example configuration of intersection 100, condition information according to an illustrative embodiment may be generated in part by combining the information available from cameras 124 and 126, and optionally from sensors 132. For example, assume that cameras 124 and 126 are each an equipment capable of capturing motion video. Video information from two video cameras obtained in this manner may be combined by overlapping the information about common objects in each video's corresponding frames.

By combining information from cameras 124 and 126 about their respective fields of view 128 and 130, a view of intersection 100 may be created such that the view may include information about pedestrian 150. Additionally, information from sensors 132 may also be combined with the view to create a view that includes information about the movement of pedestrian 150.

Figure 2:
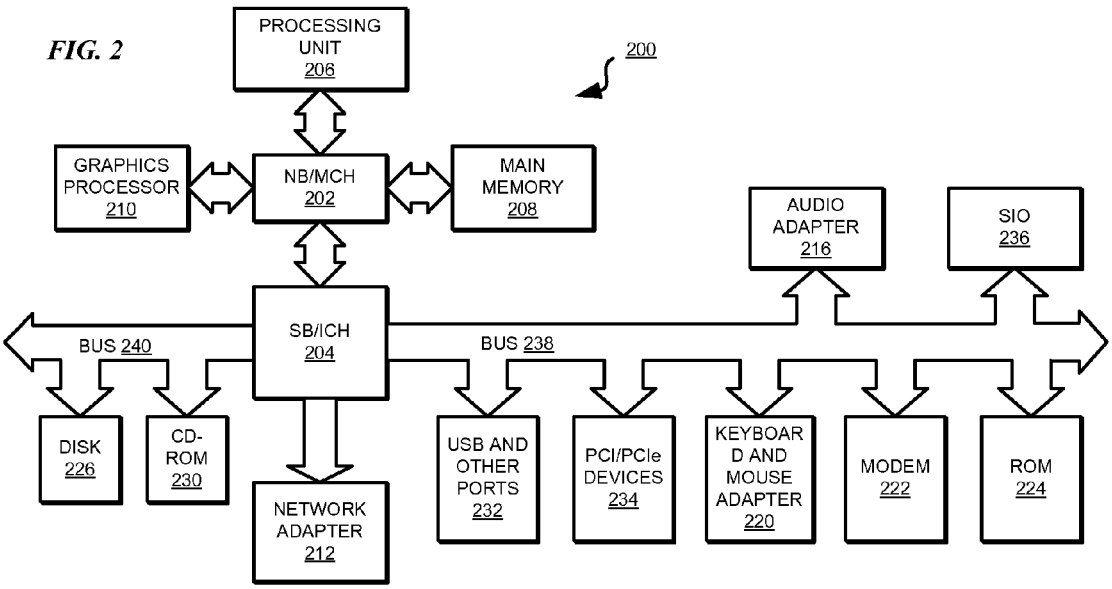
FIG. 2 depicts a block diagram of a data processing system in which illustrative embodiments may be implemented.

A data processing system may be able to combine the information received from the various input devices, such as still picture cameras, video cameras, and a variety of sensors in this manner. The data processing system may be a computer or a data processing capability associated with one or more of the input devices. Furthermore, the computer may be a server computer or a client computer. FIG. 2 depicts a configuration of a data processing system that may be used for processing the inputs from the various input devices in the manner described above.

With reference to FIG. 2, this figure depicts a block diagram of a data processing system in which illustrative embodiments may be implemented. Data processing system 200 is an example of a computer, such as a server, a client, or another data processing capability for processing inputs from various input devices as described with respect to FIG. 1. Computer usable program code or instructions implementing the processes may be located in the computer for the illustrative embodiments.

In the depicted example, data processing system 200 employs a hub architecture including North Bridge and memory controller hub (NB/MCH) 202 and south bridge and input/output (I/O) controller hub (SB/ICH) 204. Processing unit 206, main memory 208, and graphics processor 210 are coupled to north bridge and memory controller hub (NB/MCH) 202. Processing unit 206 may contain one or more processors and may be implemented using one or more heterogeneous processor systems. Graphics processor 210 may be coupled to the NB/MCH through an accelerated graphics port (AGP) in certain implementations.

In the depicted example, local area network (LAN) adapter 212 is coupled to south bridge and I/O controller hub (SB/ICH) 204. Audio adapter 216, keyboard and mouse adapter 220, modem 222, read only memory (ROM) 224, universal serial bus (USB) and other ports 232, and PCI/PCIe devices 234 are coupled to south bridge and I/O controller hub 204 through bus 238. Hard disk drive (HDD) 226 and CD-ROM 230 are coupled to south bridge and I/O controller hub 204 through bus 240. PCI/PCIe devices may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM 230 may use, for example, an integrated drive electronics (IDE) or serial advanced technology attachment (SATA) interface. A super I/O (SIO) device 236 may be coupled to south bridge and I/O controller hub (SB/ICH) 204.

An operating system runs on processing unit 206. The operating system coordinates and provides control of various components within data processing system 200 in FIG. 2. The operating system may be a commercially available operating system such as Microsoft® Windows® XP (Microsoft and Windows are trademarks of Microsoft Corporation in the United States and other countries), or Linux® (Linux is a trademark of Linus Torvalds in the United States and other countries). An object oriented programming system, such as the Java™ programming system, may run in conjunction with the operating system and provides calls to the operating system from Java™ programs or applications executing on data processing system 200 (Java is a trademark of Sun Microsystems, Inc., in the United States and other countries).

Instructions for the operating system, the object-oriented programming system, and applications or programs are located on storage devices, such as hard disk drive 226, and may be loaded into main memory 208 for execution by processing unit 206. The processes of the illustrative embodiments may be performed by processing unit 206 using computer implemented instructions, which may be located in a memory, such as, for example, main memory 208, read only memory 224, or in one or more peripheral devices.

The hardware in FIG. 2 may vary depending on the implementation. Other internal hardware or peripheral devices, such as flash memory, equivalent non-volatile memory, or optical disk drives and the like, may be used in addition to or in place of the hardware depicted in FIG. 2. In addition, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may comprise one or more buses, such as a system bus, an I/O bus, and a PCI bus. Of course, the bus system may be implemented using any type of communications fabric or architecture that provides for a transfer of data between different components or devices attached to the fabric or architecture.

A communications unit may include one or more devices used to transmit and receive data, such as a modem or a network adapter. A memory may be, for example, main memory 208 or a cache, such as the cache found in north bridge and memory controller hub 202. A processing unit may include one or more processors or CPUs.

The depicted examples in FIG. 2 and above-described examples are not meant to imply architectural limitations. For example, data processing system 200 also may be a tablet computer, laptop computer, or telephone device in addition to taking the form of a PDA. Data processing system 200 may also be a unit that may be portable or installable in an automobile.

FIG. 2 also represents an example data processing environment in which illustrative embodiments may be implemented. FIG. 2 is only an example and is not intended to assert or imply any limitation with regard to the environments in which different embodiments may be implemented. A particular implementation may make many modifications to the depicted environments based on the following description.

Figure 3:
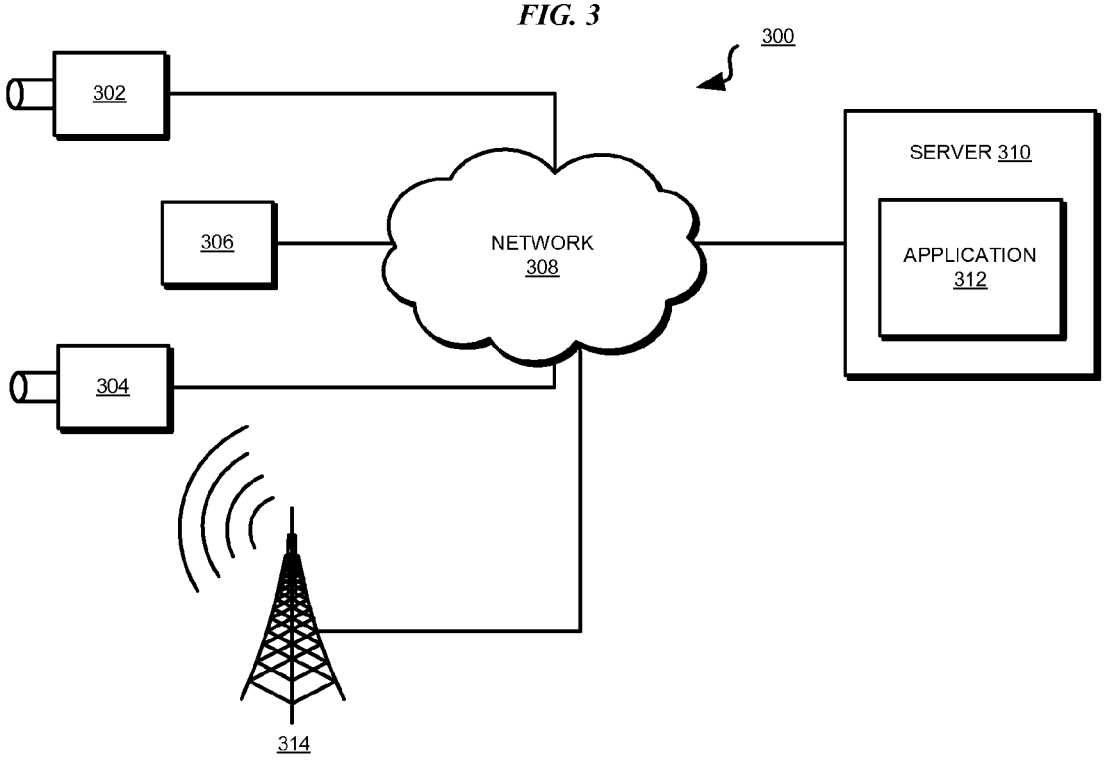
FIG. 3 depicts a block diagram of a data processing environment in which the illustrative embodiments may be implemented.

With reference to FIG. 3, this figure depicts a block diagram of a data processing environment in which the illustrative embodiments may be implemented. Data processing environment 300 includes input devices 302 and 304. As an example, input devices 302, 304, and 306 may each be a camera, such as camera 124 or 126 in FIG. 1. Data processing environment 300 may further include input device 306, which may be a sensor, such as one of sensors 132 in FIG. 1. In a particular embodiment, input devices 302, 304, and 306 may be any suitable device or transducer that generates information about surroundings relevant to a motorist, such as about intersection 100 in FIG. 1.

Input devices 302, 304, and 306 may transmit the data that they capture, over network 308. Network 308 is the medium used to provide communications links between various devices and computers connected together within data processing environment 300. Network 308 may include connections, such as wire, wireless communication links, or fiber optic cables. Server 310 may be a data processing system that may receive the data transmitted by input devices 302, 304, and 306. Server 310 may be implemented using data processing system 200 in FIG. 2.

Server 310 may include application 312. Data that server 310 receives forms inputs to application 312. Application 312 may process the inputs, such as for combining fields of view information, generating a view of the surroundings, combining sensor inputs, and other similar processing as described above. Application 312 produces a result of this processing. This result is a part of the condition information according to the illustrative embodiments and is described in detail with respect to subsequent figures.

Application 312 or a component thereof may send the result of the processing to communication device 314 using a communication component of server 310. The result of the processing form a part of the condition information about the particular surroundings where input devices 302, 304, and 306 collected their data.

Communication device 314 may be any device that is able to communicate with hardware and software in an automobile, such as vehicle 142 in FIG. 1. Furthermore, communication device 314 may use any communication method or protocol for transmitting the result of the processing to a data processing system in an automobile. For example, in one embodiment, communication device 314 may use one or more of WiFi, WiMax, Bluetooth, or other wireless data communication protocols for communicating with a data processing system in an automobile. In another embodiment, communication device may transmit data using FM band radio, or UHF video.

Additionally, in transmitting the result of the processing, communication device 314 may unicast, multicast, or broadcast the information received from application 312. Unicasting data is sending data to one recipient. Multicasting data is sending data to a group or set of more than one recipient who express interest in receiving the data. Broadcasting data is transmitting data in such a way that all recipients in a given environments can receive the data.

Furthermore, communication device 314 may use a combination of communication protocols and transmitting methods to communicate with the various automobiles. For example, communication device 314 may transmit the part of condition information to one automobile using a one-to-one WiFi connectivity, may transmit to several other automobiles using a VHF broadcast, and may transmit to several more automobiles using multicasting over a wireless network.

Figure 4:
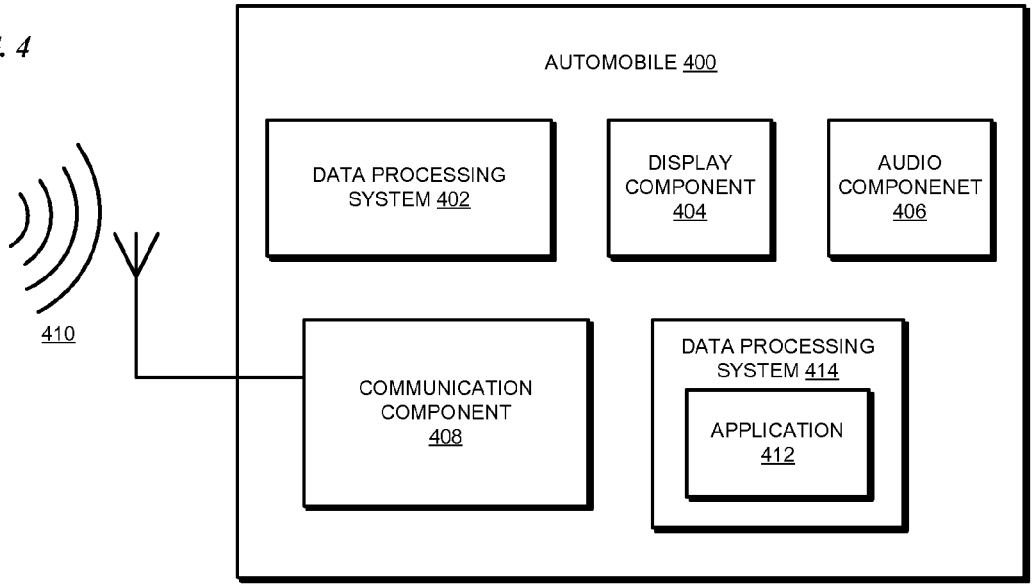
FIG. 4 depicts a block diagram of a data processing system in an automobile in which an illustrative embodiment may be implemented.

With reference to FIG. 4, this figure depicts a block diagram of a data processing system in an automobile in which an illustrative embodiment may be implemented. Automobile 400 may be analogous to vehicle 142 in FIG. 1.

Automobile 400 may include data processing system 402. Data processing system 402 may be a data processing system embedded in a media system in automobile 400, the vehicle computer in automobile 400, a data processing system of a global positioning system (GPS) navigation system in automobile 400, or other similar data processing system available in automobile 400.

Automobile 400 may further include display component 404 and audio component 406. In one embodiment, automobile 400 may not include one or more of data processing system 402, display component 404, or audio component 406. In such an embodiment, a component analogous to the missing component may be used or added without departing from the scope of the illustrative embodiments.

Automobile 400 may include communication component 408 that may receive transmitted data using antenna 410. For example, communication component 408 may be installed in automobile 142 in FIG. 1. Communication component 408 may receive the transmission containing a part of the condition information about intersection 100 in FIG. 1 that may be transmitted by communication device 314 in FIG. 3. Communication component 408 provides the information received in this manner to application 412.

Data that communication component 408 passes to application 412 is the partial condition information created by application 312 in FIG. 3. This data forms an input to application 412. Application 412 may receive other inputs as well (not shown). For example, application 412 may also receive GPS coordinates of automobile 400 periodically. Application 412 processes the various inputs and combines them to create the complete condition information.

Application 412 is depicted as executing in data processing system 414. In one embodiment, data processing system 414 and data processing system 402 may be the same. In another embodiment, data processing system 414 may be a data processing system that may be portable or installable in an automobile. In another embodiment, data processing system 414 may be a PDA. In another embodiment, data processing system 414 and 402 may be separate but able to communicate with each other. Other configurations of data processing system 402 and 414 will be apparent from this disclosure and are contemplated within the scope of the illustrative embodiments.

Application 412 may present the condition information using display component 404, audio component 406, or both. Application 412 may also communicate the condition information to data processing system 402 for further processing. Data processing system 414 may also include its own display or audio capabilities that application 412 may use for presenting the condition information.

Figure 5:
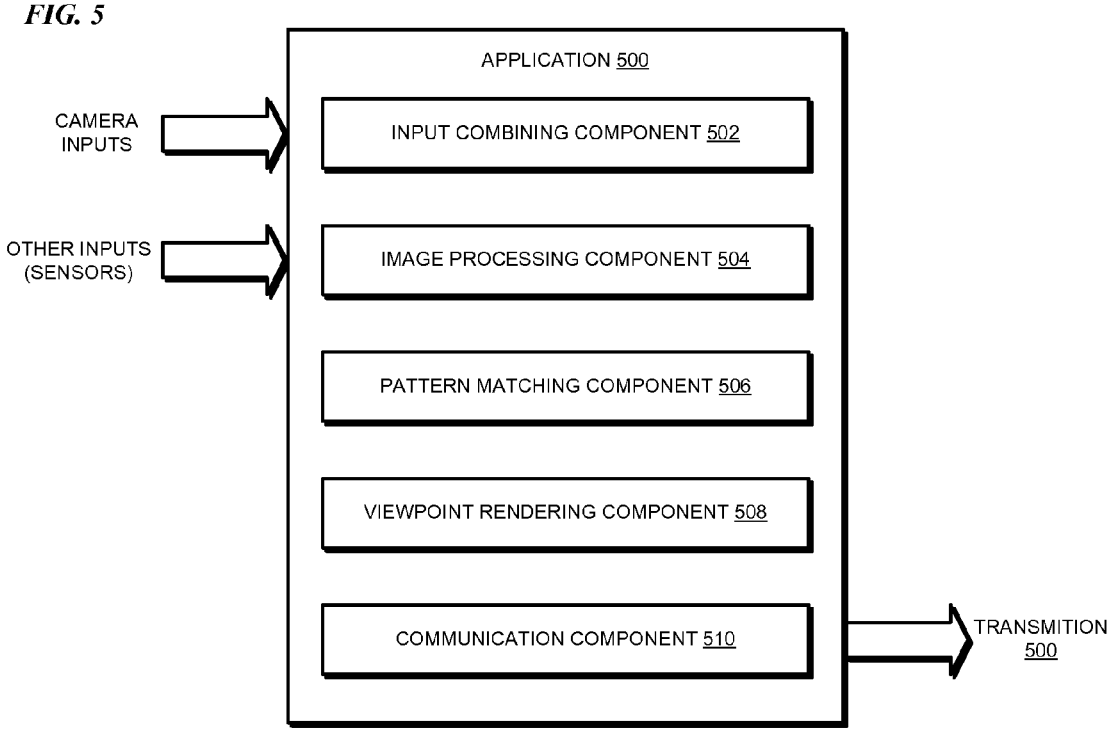
FIG. 5 depicts a block diagram of an application for creating a part of condition information in accordance with an illustrative embodiment.

With reference to FIG. 5, this figure depicts a block diagram of an application for creating a part of condition information in accordance with an illustrative embodiment. Application 500 may be implemented as application 312 in FIG. 3.

Application 500 may receive a variety of inputs, such as inputs from cameras 124 and 126, and inputs from sensors 132 in FIG. 1. Application 500 may include input combining component 502 for combining the various inputs as described with respect to FIG. 1. For example, input combining component 502 may combine the input received from a crossing sensor with input received from a camera to determine presence of a pedestrian in the crossing and the pedestrian's direction of travel.

Image processing component 504 may process image data, if contained in the inputs. For example, image processing component 504 may combine video data from fields of view 128 and 130 in FIG. 1 to create a view of intersection 100 in FIG. 1.

Pattern matching component 506 may detect patterns in the view that image processing component 504 may create. For example, pattern matching component 506 may detect a pattern in the view that matches a lane blockage barrier and highlight that pattern in the view. Similarly, pattern matching component 506 may detect patterns that match persons, vehicles, structures, or equipment in the view.

In one embodiment, application 500 may include viewpoint rendering component 508. Viewpoint rendering component 508 may render the view and the highlights described above from various points of view. For example, viewpoint rendering component 508 may render a highlighted view of intersection 100 in FIG. 1 from a point of view of a northbound vehicle two hundred feet south of the intersection, and another view from a westbound vehicle fifty yards east of the intersection. Each such rendering is called a viewpoint view. A set of viewpoint views is one or more viewpoint views.

Furthermore, viewpoint rendering component 508 may tag each viewpoint view with information sufficient to identify the vantage point related to the particular rendering. In some embodiments, application 500 may omit viewpoint rendering component 508 and produce a single view with highlights as described above.

Application 500 may include communication component 510 to transmit data containing one or more views, views with highlights, or one or more viewpoint views. Communication component 510 may transmit this data to a communication device, such as communication device 314 in FIG. 3, which in turn may transmit the data to one or more receivers in one or more automobiles, such as communication component 408 in FIG. 4.

Figure 6:
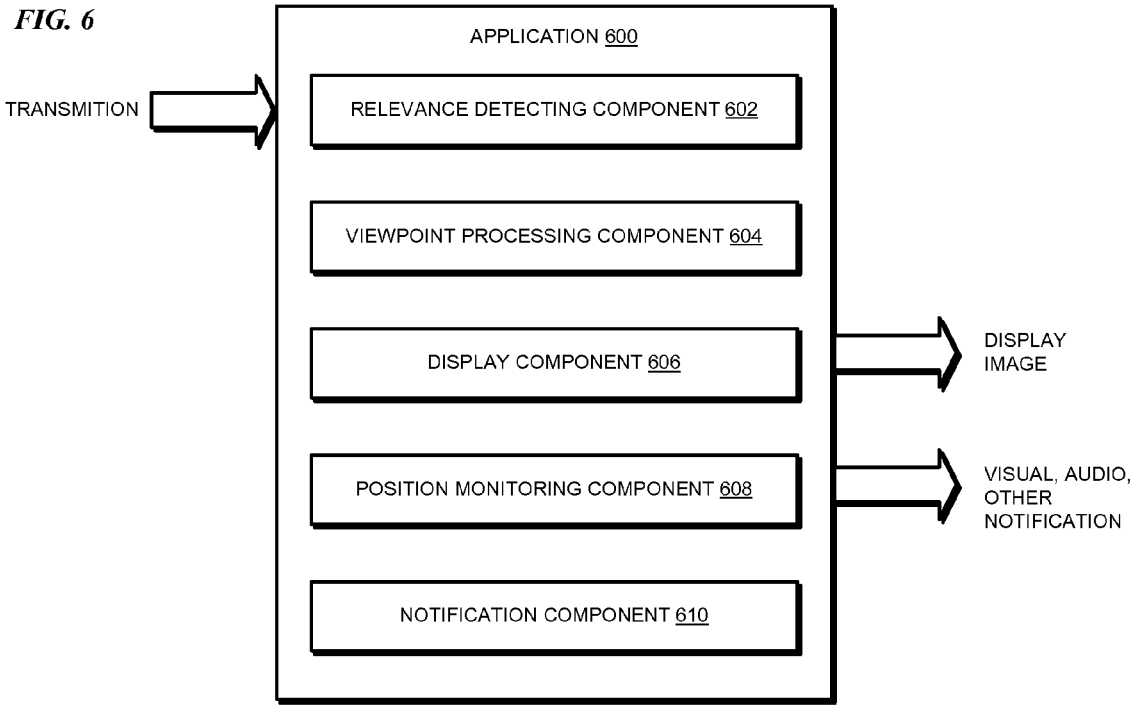
FIG. 6 depicts a block diagram of an application for processing condition information in accordance with an illustrative embodiment.

With reference to FIG. 6, this figure depicts a block diagram of an application for processing condition information in accordance with an illustrative embodiment. Application 600 may be implemented as application 412 in FIG. 4.

Application 600 may include relevance detecting component 602. Relevance detecting component 602 may determine which, if any, of the possible several data transmissions is relevant to the present situation of the automobile. For example, in crowded neighborhoods, multiple communication devices 314 in FIG. 3 may be transmitting data. An automobile at one intersection may be able to receive a transmission from a distant intersection. Relevance detecting component 602 may determine, such as by using the automobile's GPS coordinates, which transmission is relevant to the automobile's present position.

If viewpoint views are present in the data that application 600 may receive, viewpoint processing component 604 selects the viewpoint that corresponds with the automobile's present position, direction of travel, and other factors with respect to the surroundings. For example, if the automobile where application 600 is executing is travelling northbound and is south of intersection 100 in FIG. 1, viewpoint processing component 604 may use only a viewpoint view corresponding to that vantage point and reject other viewpoint views that may be present in the data.

Viewpoint processing component 604 may use information tagged to the various viewpoint views or inherent orientation of a viewpoint view to determine which viewpoint view to use. In some embodiments, application 600 may omit viewpoint processing component 604, such as when viewpoint views are not being transmitted in an implementation of application 500.

Display component 606 may display a selected view or a selected viewpoint view, with or without highlighting obstructions, pedestrians, or other objects. For example, display component 606 may use display component 404 in automobile 400 in FIG. 4 to display a view. As another example, display component 606 may use a display associated with data processing system 414 in automobile 400 in FIG. 4 to display a viewpoint view with highlights.

Position monitoring component 608 may receive or calculate present position information about the automobile where application 600 may be executing. For example, position monitoring component 608 may periodically receive or compute GPS coordinates and GPS-calculated velocity of the automobile. Using the position information about the automobile, position monitoring component 608 may determine if the view, viewpoint view, highlights, or other condition information about the surroundings has to be updated.

For example, if the automobile first received a view or other condition information when the automobile was two hundred feet from an intersection, the condition information may have to be updated as the automobile enters the intersection. Position monitoring component 608 may update the condition information in the example situation and other similarly conceivable situations in particular surroundings.

Notification component 610 may use audio, visual, or other methods of notifying the motorist about condition information. For example, if a pedestrian in present in a condition information, notification component 610 may cause a sound to be emitted from an audio component, such as audio component 406 in automobile 400 in FIG. 4. Furthermore, as position monitoring component 608 determines a change in condition information, notification component 610 may modify the method of notification, a characteristic of the notification, or a combination thereof. For example, as the automobile approaches the pedestrian, notification component 610 may cause the sound to grow louder, or cause a highlight on a view display to flash, a voice prompt to play, a steering wheel to vibrate, or any other suitable notification to occur.

Figure 7:
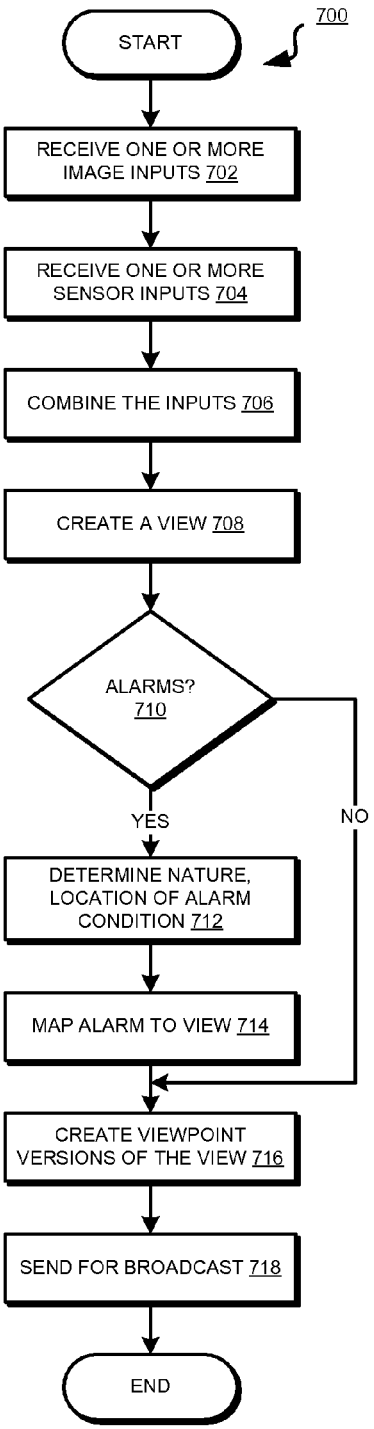
FIG. 7 depicts a flowchart of a process for detecting and sharing condition information in accordance with an illustrative embodiment.

With reference to FIG. 7, this figure depicts a flowchart of a process for detecting and sharing condition information in accordance with an illustrative embodiment. Process 700 may be implemented in application 500 in FIG. 5.

Process 700 begins by receiving one or more image inputs (step 702). In one embodiment, image inputs may be pictures from one or more still cameras. In another embodiment, image inputs may be video feeds from one or more video cameras. In another embodiment, image input may not be used at all and step 702 may be omitted.

Process 700 also receives one or more sensor inputs (step 704). In one embodiment, sensor inputs may be from one or more type of sensors sensing one or more types of events in particular surroundings. In another embodiment, sensor input may not be used at all and step 704 may be omitted. Process 700 receives some input using a combination of steps 702 and 704.

Process 700 combines the inputs (step 706). Process 700 creates a view using the combined inputs (step 708). Process 700 determines if any alarm conditions exist in the view (step 710). An alarm condition may be a pedestrian crossing a road, an equipment blocking a lane, or other similar events conceivable in particular surroundings.

If process 700 determines that an alarm condition exists ("Yes" path of step 710), process 700 determines the nature, location, or other characteristics of the alarm (step 712). For example, process 700 may determine a speed, direction of travel, or a color of clothing of the pedestrian.

Process 700 maps the alarm to the view (step 714). For example, process 700 may use a graphical icon at a particular position on a view to represent a pedestrian. As another example, process 700 may use a graphical icon of a certain color to represent a pedestrian wearing certain color clothing or to represent a particular road blockage sign.

Process 700 may create viewpoint views as a part of the condition information for transmission (step 716). If process 700 determines that no alarm conditions are present ("No" path of step 710), process proceeds to step 716 as well. Process 700 sends the condition information thus created for transmission (step 718). Process 700 ends thereafter. In one embodiment, step 716 may be omitted.

Figure 8:
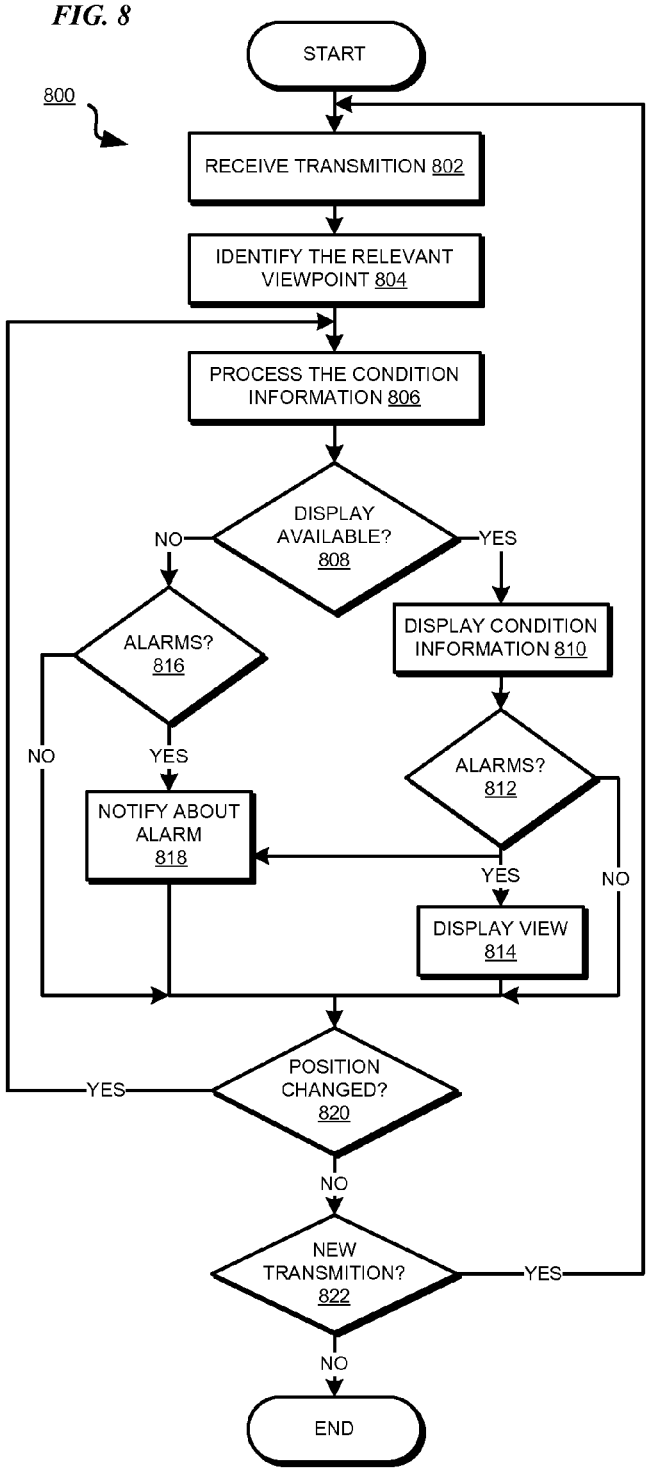
FIG. 8 depicts a flowchart of a process of receiving and processing condition information in accordance with an illustrative embodiment.

With reference to FIG. 8, this figure depicts a flowchart of a process of receiving and processing condition information in accordance with an illustrative embodiment. Process 800 may be implemented in application 600 in FIG. 6.

Process 800 begins by receiving a transmission (step 802). For example, process 800 may receive the condition information transmitted after process 700 sends the condition information for transmission in step 718 in FIG. 7.

If viewpoint views are present, or multiple transmissions are received, process 800 identifies a relevant viewpoint or view (step 804). Process 800 processes the condition information (step 806). For example, process 800 may re-orient a view, change a graphical icon, or modify the condition information as described above.

Process 800 determines if a display capability is available for displaying the condition information (step 808). If a display capability is available ("Yes" path of step 808), process 800 displays the condition information (step 810).

Process 800 determines if any alarm conditions are present in the condition information (step 812). If one or more alarm conditions are present in the condition information ("Yes" path of step 812), process 800 displays the alarm conditions (step 814).

Returning to step 808, if a display is not available ("No" path of step 808), process 800 determines if any alarm conditions are present in the condition information (step 816). If one or more alarm conditions are present in the condition information ("Yes" path of step 816), process 800 notifies about the alarm conditions, such as by using an audible notification (step 818). Some examples of audible notifications are a beep, a chime, a speech pattern, and a buzzer. Following the "Yes" path of step 812, process 800 may display the alarm conditions using step 814 and also use other notification, such as audible notification, using step 818.

Process 800 determines if the position of the automobile where process 800 may be executing has changed since receiving the transmission in step 802 (step 820). If the position has changed ("Yes" path of step 820), process 800 returns to step 806. If the position has not changed ("No" path of step 820), process 800 determines if a new transmission is available (step 822). If a new transmission is available ("Yes" path of step 822), process 800 returns to step 802. If a new transmission is not available ("No" path of step 822), process 800 ends thereafter.

The components in the block diagrams and the steps in the flowcharts and timing diagrams described above are described only as examples. The components and the steps have been selected for the clarity of the description and are not limiting on the illustrative embodiments. For example, a particular implementation may combine, omit, further subdivide, modify, augment, reduce, or implement alternatively, any of the components or steps without departing from the scope of the illustrative embodiments. Furthermore, the steps of the processes described above may be performed in a different order within the scope of the illustrative embodiments.

Thus, a computer implemented method, apparatus, and computer program product are provided in the illustrative embodiments for detecting and sharing road traffic condition information. Devices available in particular surroundings may collect information about road traffic conditions in those surroundings. A system may combine and process the information from such devices to create a part of the condition information. The part of the condition information provides all receivers same or similar information, albeit in different forms or from different vantage points.

A system in an automobile receives this part of the condition information. The system in the automobile combines this part of the condition information with automobile-specific information, such as location and velocity of the automobile, to create the complete condition information. The condition information is then presented to the motorist. The motorist is thus able to determine conditions in the motorist's surroundings that the motorist may not be able to perceive otherwise.

The invention can take the form of an entirely hardware embodiment, an entirely software embodiment, or an embodiment containing both hardware and software elements. In a preferred embodiment, the invention is implemented in software, which includes but is not limited to firmware, resident software, and microcode.

Furthermore, the invention can take the form of a computer program product accessible from a computer-usable or computer-readable medium providing program code for use by or in connection with a computer or any instruction execution system. For the purposes of this description, a computer-usable or computer-readable medium can be any tangible apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk, and an optical disk. Current examples of optical disks include compact disk—read only memory (CD-ROM), compact disk—read/write (CD-R/W) and DVD.

Further, a computer storage medium may contain or store a computer-readable program code such that when the computer-readable program code is executed on a computer, the execution of this computer-readable program code causes the computer to transmit another computer-readable program code over a communications link. This communications link may use a medium that is, for example without limitation, physical or wireless.

A data processing system suitable for storing and/or executing program code will include at least one processor coupled directly or indirectly to memory elements through a system bus. The memory elements can include local memory employed during actual execution of the program code, bulk storage, and cache memories, which provide temporary storage of at least some program code in order to reduce the number of times code must be retrieved from bulk storage during execution.

A data processing system may act as a server data processing system or a client data processing system. Server and client data processing systems may include data storage media that are computer usable, such as being computer readable. A data storage medium associated with a server data processing system may contain computer usable code. A client data processing system may download that computer usable code, such as for storing on a data storage medium associated with the client data processing system, or for using in the client data processing system. The server data processing system may similarly upload computer usable code from the client data processing system. The computer usable code resulting from a computer usable program product embodiment of the illustrative embodiments may be uploaded or downloaded using server and client data processing systems in this manner.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to explain the principles of the invention, the practical application, and to enable others of ordinary skill in the art to understand the invention for various embodiments with various modifications as are suited to the particular use contemplated.

What is claimed is:

1. A computer implemented method for detecting and sharing road traffic condition information, the computer implemented method comprising:

receiving a set of image inputs from a set of cameras monitoring a road traffic, wherein the set of cameras is stationary relative to a road;

combining the image inputs in the set of image inputs to form a graphically presentable view;

determining, using video analysis, whether an alarm condition exists in the graphically presentable view;

mapping the alarm condition on the view using a characteristic of the alarm condition, the mapping modifying the graphically presentable view by adding a graphical object corresponding to the characteristic of the alarm condition to the graphically presentable view, forming a part of a condition information; and transmitting the part of the condition information, such that the part of the condition information can be received by a motorist in an automobile.

2. The computer implemented method of claim 1, further comprising:

receiving a set of sensor inputs from a set of sensors; and combining the set of sensor inputs with the set of image inputs to form the graphically presentable view.

3. The computer implemented method of claim 2, further comprising:

using one of (i) a sensor input in the set of sensor inputs, (ii) an image input in the set of image inputs, (iii) a combination of a sensor input in the set of sensor inputs and an image input in the set of image inputs, to determine whether the alarm condition exists.

4. The computer implemented method of claim 1, further comprising:

creating a version of the part of the condition information from a particular vantage point in the road traffic, the particular vantage point being distinct from a vantage point of a location of the set of cameras, the version of the part of the condition information presenting the graphically presentable view and the graphical object in an orientation observable from the particular vantage point; and transmitting the version of the part of the condition information to the automobile.

5. The computer implemented method of claim 1, wherein transmitting the part of the condition information includes one of (i) unicasting, (ii) multicasting, and (iii) broadcasting, the part of the condition information.

6. The computer implemented method of claim 1, wherein the alarm condition is an object that is obscured from any view of the motorist.

7. A computer implemented method for receiving road traffic condition information, the computer implemented method comprising:

receiving, at an automobile, a part of a condition information, the part of the condition information comprising a graphically presentable view formed by combining image inputs in a set of image inputs from a set of cameras and a graphical object corresponding to a characteristic of an alarm condition, where the graphical object modifies the graphically presentable view;

determining whether the part of the condition information is relevant to the automobile;

determining, responsive to the part of the condition information being relevant, an information about a position of the automobile with respect to the road traffic;

combining the information about the position with the part of the condition information, forming a complete condition information; and presenting the complete condition information to a motorist associated with the automobile.

8. The computer implemented method of claim 7, further comprising:

monitoring a change in the position;

updating the complete condition information according to the change in the position, forming an updated condition information; and presenting the updated condition information to the motorist.

9. The computer implemented method of claim 8, wherein each of (i) presenting the updated condition information and (ii) presenting the complete condition information, use a variation of a characteristic of one of (i) a display and (ii) an audible notification, and wherein the updated condition information and the complete condition information each include information from the graphically presentable view.

10. The computer implemented method of claim 7, wherein determining whether the part of the condition information is relevant further comprises:

determining whether the part of the condition information corresponds to the position of the automobile.

11. The computer implemented method of claim 7, wherein the part of the condition information includes a plurality of versions of the part of the condition information, a version in the plurality of versions being from a particular vantage point in the road traffic, the version presenting the graphically presentable view and the graphical object in an orientation observable from the particular vantage point in the road traffic, the particular vantage point being distinct from a vantage point of a location of a camera in the set of cameras, and wherein determining whether the part of the condition information is relevant further comprises:

selecting a version from the plurality of versions of the part of the condition information that corresponds with the vantage point of the motorist in the road traffic.

12. The computer implemented method of claim 7, wherein presenting the complete condition information includes one of (i) displaying the complete condition information and (ii) providing audible notification about the complete condition information.

13. The computer implemented method of claim 7, wherein the position includes position coordinates received from a global positioning system.

14. A computer usable program product comprising a computer usable storage medium including computer usable code for receiving road traffic condition information, the computer usable code comprising:

computer usable code for receiving, at an automobile, a part of a condition information, the part of the condition information comprising a graphically presentable view formed by combining image inputs in a set of image inputs from a set of cameras and a graphical object corresponding to a characteristic of an alarm condition, where the graphical object modifies the graphically presentable view;

computer usable code for determining whether the part of the condition information is relevant to the automobile;

computer usable code for determining, responsive to the part of the condition information being relevant, an information about a position of the automobile with respect to the road traffic;

computer usable code for combining the information about the position with the part of the condition information, forming a complete condition information; and computer usable code for presenting the complete condition information to a motorist associated with the automobile.

15. The computer usable program product of claim 14, further comprising:

computer usable code for monitoring a change in the position;

computer usable code for updating the complete condition information according to the change in the position, forming an updated condition information; and computer usable code for presenting the updated condition information to the motorist.

16. The computer usable program product of claim 15, wherein each of (i) the computer usable code for presenting the updated condition information and (ii) the computer usable code for presenting the complete condition information, use a variation of a characteristic of one of (i) a display and (ii) an audible notification, and wherein the updated condition information and the complete condition information each include information from the graphically presentable view.

17. The computer implemented method of claim 14, wherein the computer usable code for determining whether the part of the condition information is relevant further comprises:

computer usable code for determining whether the part of the condition information corresponds to the position of the automobile.

18. The computer usable program product of claim 14, wherein the part of the condition information includes a plurality of versions of the part of the condition information, a version in the plurality of versions being from a particular vantage point in the road traffic, the version presenting the graphically presentable view and the graphical object in an orientation observable from the particular vantage point in the road traffic, the particular vantage point being distinct from a vantage point of a location of a camera in the set of cameras, and wherein the computer usable code for determining whether the part of the condition information is relevant further comprises:

computer usable code for selecting a version from the plurality of versions of the part of the condition information that corresponds with the vantage point of the motorist in the road traffic.

19. The computer usable program product of claim 14, wherein the computer usable code for presenting the complete condition information includes one of (i) computer usable code for displaying the complete condition information and (ii) computer usable code for providing audible notification about the complete condition information.

20. The computer usable program product of claim 14, wherein the position includes position coordinates received from a global positioning system.

* * * * *